US005394944A

United States Patent [19]

Theurer et al.

[11] Patent Number: 5,394,944

[45] Date of Patent: Mar. 7, 1995

[54] INSTALLATION FOR THE CONTINUOUS REHABILITATION OF A BALLAST BED

[75] Inventors: Josef Theurer, Vienna; Herbert Wörgötter, Gallneukirchen, both of Austria

[73] Assignee: Franz Plasser Bahnbaumaschinen-Industriegesellschaft m.b.H., Vienna, Austria

[21] Appl. No.: 36,712

[22] Filed: Mar. 25, 1993

[30] Foreign Application Priority Data

Apr. 29, 1992 [AT] Austria ..... 880/92

[51] Int. Cl.[6] ..... E01B 27/10

[52] U.S. Cl. ..... 171/16; 37/104; 104/2

[58] Field of Search ..... 171/16; 104/2; 37/104

[56] References Cited

U.S. PATENT DOCUMENTS 3,612,184 10/1971 Plasser ..... 171/16
4,770,104 9/1988 Theurer .
4,794,862 1/1989 Theurer ..... 171/16
4,813,488 3/1989 Theurer .
4,854,243 8/1989 Theurer ..... 171/16
4,892,151 1/1990 Theurer et al. .
4,913,240 4/1990 Mancini .
5,084,989 2/1992 Theurer et al. ..... 171/16
5,094,018 3/1992 Theurer et al. ..... 171/16
5,172,636 12/1992 Theurer et al. ..... 171/16

*Primary Examiner*—Randolph A. Reese
*Assistant Examiner*—Spencer Warnick
*Attorney, Agent, or Firm*—Collard & Roe

[57] ABSTRACT

An installation for the continuous rehabilitation of a ballast bed comprises an elongated machine frame supported on the track by undercarriages for movement in an operating direction, and mounted on the machine frame are a vertically adjustable ballast excavating device for excavating dirty ballast, a screening device for cleaning the excavated dirty ballast, a storage bin for holding bulk material and arranged rearwardly of the screening device in the operating direction and close to the rear end of the machine frame means, a conveyor device for conveying ballast to the storage bin, the storage bin comprising an input opening for delivering bulk material to the bin independently of the conveyor device, and a discharge device arranged to receive the bulk material from the storage bin and to discharge the received bulk material to the subgrade.

9 Claims, 1 Drawing Sheet

INSTALLATION FOR THE CONTINUOUS REHABILITATION OF A BALLAST BED

BACKGROUND OF THE INVENTION

1. Field of the Invention

The present invention relates to an installation for the continuous rehabilitation of a ballast bed resting on a subgrade for supporting a track including two rails, which comprises an elongated machine frame means extending in a longitudinal direction and supported on the track by undercarriages for movement in an operating direction, the machine frame means having a rear end in the operating direction. Mounted on the machine frame means are a vertically adjustable ballast excavating device for continuously excavating dirty ballast, a screening device for cleaning the excavated dirty ballast, a conveyor device for conveying ballast to a storage bin, and a discharge device arranged to receive bulk material from the storage bin and to discharge the received bulk material to the subgrade.

2. Description of the Prior Art

U.S. Pat. No. 4,892,151 discloses an installation for the rehabilitation of a track ballast bed, which comprises an elongated machine frame supported on the track for movement in an operating direction. Mounted on the machine frame is a vertically adjustable ballast excavating device including an endless excavating chain which continuously receives and removes dirty ballast from the ballast bed. In a direction opposite to the operating direction, the excavated dirty ballast is conveyed to a screening device mounted on a separate machine frame coupled to the first-named machine frame, and the dirty ballast is screened by this device to produce cleaned ballast and detritus. The detritus is conveyed by a conveyor band arrangement forwardly in the operating direction for discharge into freight cars or on the shoulders of the track. The cleaned ballast is conveyed by another conveyor band arrangement to a storage bin on the machine frame and the storage bin has a discharge device for discharging the cleaned ballast on the subgrade by means of discharge conveyor bands which are pivotal in a horizontal plane and, additionally, outlets arranged laterally of the discharge conveyor bands at the tie ends. The installation may be used for a total removal of the ballast so that a totally new ballast bed may be laid, in which case the separate machine frame carrying the screening device is uncoupled and is replaced by freight cars which receive and remove the dirty ballast. With respect of delivering bulk material to an existing ballast bed for the rehabilitation thereof, this installation is limited to the cleaned ballast coming from the screening device.

U.S. Pat. No. 4,913,240 discloses a machine which can be used selectively for cleaning the ballast bed supporting a track and for completely renewing it. This machine comprises a machine frame whose opposite ends are supported on the track by undercarriages and a vertically adjustable excavating device arranged on the machine frame centrally between the undercarriages and including an endless excavating chain for continuously excavating dirty ballast. The dirty ballast is conveyed by a conveyor band to a ballast screening device arranged forwardly of the excavating device in the operating direction for cleaning the dirty ballast. If a total removal of the ballast bed is desired, the dirty ballast is further conveyed without screening to a front end of the machine frame where it is discharged. If the dirty ballast is screened, only the detritus coming the screening device is forwardly conveyed for removal while the cleaned ballast is conveyed by a conveyor device to a discharge device behind the ballast excavating point in the operating direction for redistribution in the ballast bed. Two additional adjacent conveyor devices are arranged at the rear end of the machine frame for receiving additional track bed material from storage cars coupled to the machine frame. One of the additional conveyor devices is arranged to deliver additional track bed material by way of a transfer conveyor band to the discharge device while the other additional conveyor device is connected to discharge chutes leading to the shoulders of the track behind the discharge device. This installation has a relatively complex structure and is difficult to operate because, in addition to the excavation, several discharge points as well as planing, redistributing and compacting devices must be monitored.

SUMMARY OF THE INVENTION

It is the primary object of this invention to provide a ballast bed rehabilitation installation of the first-described type which enables different bulk material to be selectively delivered to the ballast bed without requiring retrofitting and while largely maintaining the existing structure of generally conventional ballast cleaning machines.

In an installation for the continuous rehabilitation of a ballast bed resting on a subgrade for supporting a track including two rails, which comprises an elongated machine frame means extending in a longitudinal direction and supported on the track by undercarriages for movement in an operating direction, the machine frame means having a rear end in the operating direction, and a vertically adjustable ballast excavating device for continuously excavating dirty ballast and a screening device for cleaning the excavated dirty ballast mounted on the machine frame means, the above and other objects are accomplished according to the invention with a storage bin for holding bulk material and arranged rearwardly of the screening device in the operating direction and close to the rear end of the machine frame means, a conveyor device for conveying ballast to the storage bin, the storage bin comprising an input opening for delivering bulk material to the bin independently of the conveyor device, and a discharge device arranged to receive the bulk material from the storage bin and to discharge the received bulk material to the subgrade.

At a relatively small additional cost for structural changes, this arrangement considerably enhances the usefulness of the installation for various different rehabilitation operations. It is a particular advantage of such an installation that it incorporates the basic structure of commercially very successful ballast cleaning machines unchanged while the added input opening for the storage bin enables either cleaned ballast from the screening device, such cleaned ballast together with additional clean ballast, or sand or clean ballast exclusively to be supplied selectively for the rehabilitation of the ballast bed. These different movements of bulk material through the storage bin make it possible in an advantageous manner to use the installation for cleaning the ballast and immediately redistributing the cleaned ballast, as well as for rehabilitating the subgrade by applying a protective layer over the subgrade, which usually consists of a mixture of sand and small rocks, without requiring time- and labor-intensive retrofitting work for the different uses. Mounting the storage bin close to the rear end of the machine frame means assures a simplified conveyance of clean ballast or sand to the input opening of the storage bin from freight cars succeeding the installation, on the one hand, and a connection of the storage bin to the conveyor and discharge devices, on the other hand.

According to a preferred embodiment, the input opening is a funnel spaced from the storage bin in the direction of the rear end. In this way, clean ballast or sand may be discharged directly into the input opening from a transfer conveyor band of a freight car coupled to the rear end.

The installation preferably further comprises an operator's cab mounted on the machine frame means near the rear end thereof and above the storage bin, which may have a bottom window arranged to permit a free view of the storage bin therebelow. This saves space for the arrangement of the storage bin and enables an operator in the cab to observe the amount of bulk material in the bin.

In one preferred embodiment, the conveyor device is a conveyor band arrangement having an input end arranged to receive the cleaned ballast from the screening device, and the installation further comprises a conveyor band arranged to receive the dirty ballast from the ballast excavating device and to convey the dirty ballast towards the screening device, the conveyor band having a discharge end above the input end of the conveyor band arrangement. This makes it possible to divide the machine frame means into two machine frames, which may be coupled to, and detached from, each other so that the screening device may be mounted on a detachable machine frame which may be rapidly and readily uncoupled when it is desired to use the installation for rehabilitation solely with sand and new clean ballast.

In another preferred embodiment, the storage bin is mounted on the machine frame means ahead of a rear one of the undercarriages in the operating direction, and the installation further comprises a power-driven transfer conveyor band extending in the longitudinal direction between the rear end of the machine frame means and the input opening of the storage bin for delivering bulk material to the storage bin. The transfer conveyor band makes the transfer of bulk material from an adjoining freight car easier, particularly if there is a substantial distance between the rear end of the machine frame means and the storage bin.

The discharge device is preferably comprised of two independently power-driven discharge conveyor bands extending in the longitudinal direction, a respective one of the discharge conveyor bands extending above each one of the track rails, and further comprising a respective drive for pivoting each one of the discharge conveyor bands about a vertical axis. This enables the stored bulk material to be accurately discharged at each side of each track rail where the rails and ties intersect, and it is possible to vary the driving speed of the conveyor bands to adapt the amount of discharged bulk material rapidly to different requirements. If each one of the discharge conveyor bands has an input end directly below a discharge opening of the storage bin, they may serve at the same time as effective closures of the discharge opening when they are not driven, thus avoiding the need for special closure mechanisms which increase the cost and which may malfunction.

According to yet another preferred embodiment, the screening device is mounted on the machine frame means directly rearwardly of the ballast excavating device, the conveyor device is arranged between the screening device and the storage bin for conveying the ballast cleaned in the screening device to the storage bin, and the installation further comprises a conveyor band arrangement mounted on the machine frame means for conveying detritus forwardly in the operating direction. This simple adaptation of a known ballast cleaning machine makes the installation particularly useful for a variety of ballast bed rehabilitation operations.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figure 1:
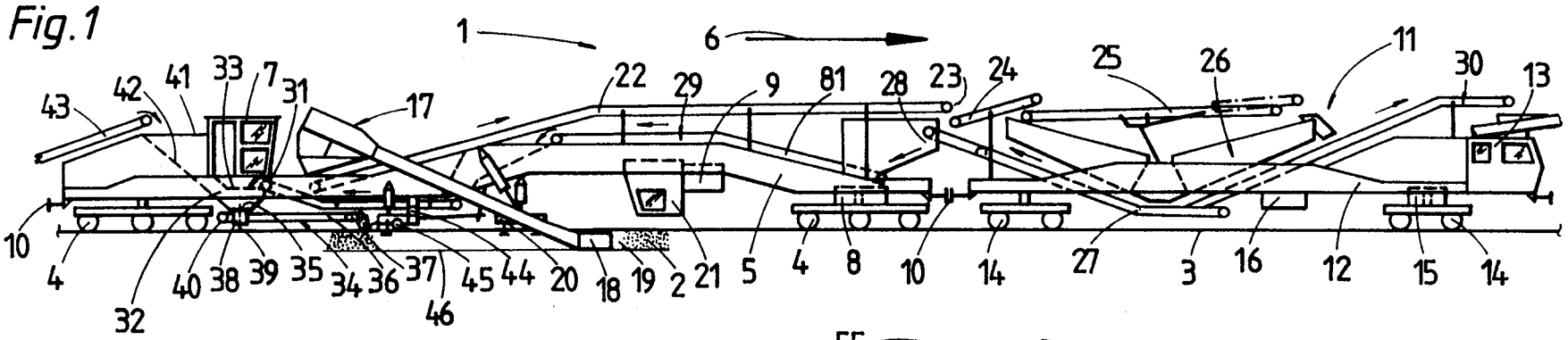
FIG. 1 is a side elevation showing one embodiment of an installation according to this invention.

Referring now to the drawing and first to FIG. 1, there is shown installation 1 for the continuous rehabilitation of a ballast bed 2 resting on subgrade 46 for supporting track 3 including two rails. Installation 1 comprises an elongated machine frame means consisting of machine frame 5 and machine frame 12 coupled together at 10. The machine frame means extends in a longitudinal direction and is supported on the track by undercarriages 4, 4 and 14, 14 for movement in an operating direction indicated by arrow 6. Machine frame means 5, 12 has a rear end in the operating direction.

Driving and operator's cab 7 is mounted on the rear end of the machine frame means, and installation 1 is movable on track 3 by drive 8. This drive as well as the various operating drives of the installation are supplied with power from energy supply unit 9 mounted on machine frame 5. In the embodiment of FIG. 1, machine frame 12 may be detached from machine frame 5 by uncoupling coupling 10 so that the two machine frames may be operated independently of each other. Thus, machine frame 5 may constitute an independently operating screening car 11 which can be coupled to the front end of machine frame 5 for movement therewith but which may be self-propelled by drive 15 supplied with power from energy supply unit 16 mounted on machine frame 12. Driver's cab 13 is mounted on the front end of machine frame 12.

Mounted on the machine frame means, i.e. substantially centrally between undercarriages 4, 4 on machine frame 5, is vertically adjustable ballast excavating device 17 for continuously excavating dirty ballast by means of endless excavating chain 18 revolving in ballast 2 underneath track 3. Track lifting device 20 comprising rail engaging lifting rollers is mounted on machine frame 5 adjacent ballast excavating location 19 and operator's cab 21 is suspended from an underside of the machine frame to enable an operator to monitor and control the operation. Screening device 26 for cleaning the excavated dirty ballast is mounted on machine frame 12. Storage bin 32 for holding bulk material is also mounted on the machine frame means and is arranged rearwardly of screening device 26 in the operating direction and close to the rear end of the machine frame means. Conveyor device 29 for conveying ballast to storage bin 32 is also mounted on the machine frame means and the storage bin comprises input opening 41 for delivering bulk material to bin 32 independently of conveyor device 29. Discharge device 34 is arranged on the machine frame means to receive the bulk material from storage bin 32 and to discharge the received bulk material to track 3 and subgrade 46. The discharge device receives the bulk material rearwardly of excavating point 19 in the operating direction through outlet openings 35 of storage bin 32.

As shown in FIG. 1, input opening 41 of storage bin 32 is a funnel spaced from the storage bin in the direction of the rear end. Operator's cab 7 is mounted on the machine frame means near the rear end thereof and above storage bin 32, and cab 7 has bottom window 33 arranged to permit a free view of the storage bin therebelow.

Conveyor device 29 is a conveyor band arrangement 81 having input end 28 arranged to receive the cleaned ballast from screening device 26 and to convey the cleaned ballast in a direction opposite to the operating direction (see small arrows) to discharge end 31 where the cleaned ballast is discharged into storage bin 32 close to the rear end of machine frame 5. The operator in cab 7 is able to observe the filling of the bin through bottom window 33.

The installation further comprises conveyor band 22 arranged to receive the dirty ballast from ballast excavating device 17 and to convey the dirty ballast towards the screening device. Conveyor band 22 has a discharge end 23 above input end 28 of conveyor band arrangement 81. Conveyor band 22 extends in the longitudinal direction and receives the dirty ballast from excavating device 17 for conveyance to discharge end 23 near the front of machine frame 5 whence the dirty ballast is further conveyed by transfer conveyor band 24 to conveyor band 25 which throws the dirty ballast into screening device 26 for cleaning, i.e. the separation of the detritus from the clean ballast. The cleaned ballast is then returned by return conveyor band 27 which extends below screening device 26 for receiving the cleaned ballast and conveying the same in a direction opposite to the operating direction to input end 28 of conveyor band arrangement 81 which conveys the cleaned ballast to storage bin 32 and discharges it thereinto. The detritus coming from screening device 26 is received by further conveyor band arrangement 30 which conveys it forwardly to be discharged into freight cars (not shown) which precede ballast screening car 11. As indicated in phantom lines, conveyor band 25 is displaceable in the longitudinal direction so that it may selectively discharge the dirty ballast received from conveyor band 22 into screening device 26 for cleaning or onto conveyor band arrangement 30 for removal.

As also shown in FIG. 1, storage bin 32 is mounted on machine frame 5 ahead of a rear undercarriage 4 in the operating direction, and the installation further comprises power-driven transfer conveyor band 43 extending in the longitudinal direction between the rear end of machine frame 5 and input opening 41 of storage bin 32 for delivering bulk material, such as sand or clean ballast, to the storage bin, independently of the delivery of the cleaned ballast coming from screening device 26. Transfer conveyor band 43 receives the desired bulk material from a freight car or another track working machine following installation 1. In this way and depending on the prevalent operating requirements, the storage bin may deliver to discharge device 34 either only cleaned ballast coming from screening device 26, a mixture thereof with additional clean ballast conveyed by transfer conveyor band 43 (in case more ballast is required for the rehabilitation of the ballast bed), or sand for laying a protective layer on subgrade 46. In other words, installation 1 may be used for a conventional ballast bed rehabilitation in which the ballast is cleaned and then returned to the track, with or without supplemental ballast, or it may be used for a total renewal of the ballast bed, in which conveyor band 25 is forwardly displaced to remove the dirty ballast instead of discharging it into screening device 26 for cleaning and new clean ballast is delivered to storage bin 32 by transfer conveyor band 43 for discharge on subgrade 46. In this case, it may be desired first to lay a protective sand layer on the exposed subgrade, which may be done by first delivering sand to the storage bin by transfer conveyor 43 and then delivering and discharging the new ballast over the protective layer. For the total excavation of the old ballast bed and a renewal thereof by new ballast, ballast screening car 11 is not needed and, therefore, machine frame 12 may be detached from machine frame 5 during such an operation and, instead, a freight car may be coupled to machine frame 5 to receive and remove the dirty ballast coming from conveyor band 22. It would also be possible to deliver new ballast stored in freight cars preceding machine frame 5 to input end 28 of conveyor device 29.

Discharge device 34 is comprised of two independently driven discharge conveyor bands 36 driven by a respective power drive 37 and extending in the longitudinal direction and a respective discharge conveyor band 36 extends above each track rail. Furthermore, a respective drive 38 enables each discharge conveyor band to be pivoted about vertical axis 39, each discharge conveyor band 36 having an input end 40 directly below a discharge opening 35 of storage bin 32. Vibration device 45, which engages the rails of track 3 and imparts vibrations thereto, is linked to machine frame 5 near the discharge end of discharge device 34 whereby the discharged ballast may be compacted. Vibration device 45 comprises a crank drive 44 extending transversely to the longitudinal direction.

Figure 2:
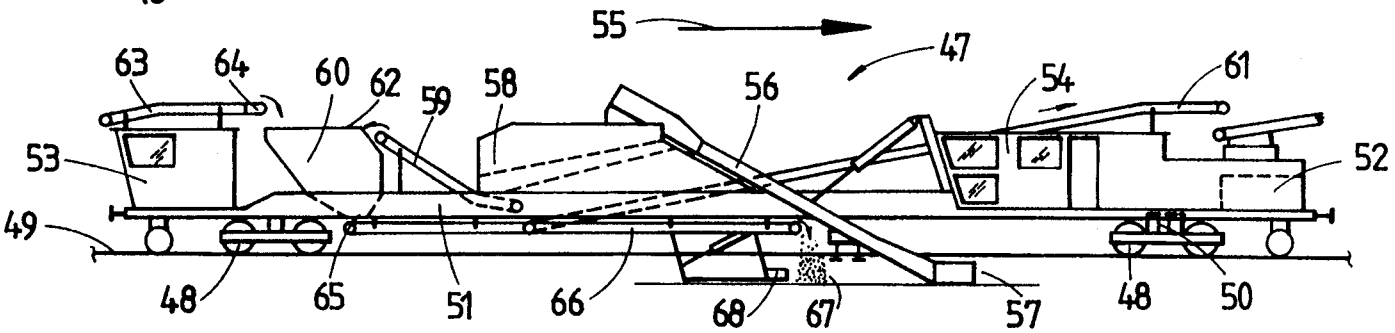
FIG. 2 is a like view showing another embodiment of the installation.

FIG. 2 illustrates an installation 47 wherein screening device 58 is mounted on the machine frame means directly rearwardly of ballast excavating device 56, conveyor device 59 is arranged between screening device 58 and storage bin 60 for conveying the ballast cleaned in the screening device to the storage bin. Installation 47 further comprises conveyor band arrangement 61 mounted on the machine frame means for conveying detritus forwardly in the operating direction indicated by arrow 55.

In this embodiment, the machine frame means is constituted by single elongated machine frame 51 supported by undercarriages 48 on track 49 and driven by drive 50. The machine frame carries central power plant 52 for supplying energy to all operating drives and driving and operator's cabs 53, 54 at respective machine frame ends. Vertically adjustable excavating device 56 is arranged within sight of front operator's cab 54 for receiving and excavating dirty ballast at excavating point 57 and for conveying the excavated ballast directly to screening device 58. Conveyor device 59 conveys the cleaned ballast from the screening device to storage bin 60 arranged rearwardly thereof while the detritus separated in the screening device from the cleaned ballast is removed by conveyor band arrangement 61. If desired, the entire dirty ballast coming from excavating device 56 may be removed by this conveyor band arrangement if total renewal of the ballast bed is desired.

Transfer conveyor band 63 extending in the longitudinal direction at the rear end of machine frame 51 and driven by drive 64 is able to deliver ballast bed material, such as new ballast or sand, to input opening 62 of storage bin 60 which is arranged ahead of rear undercarriage 48 in the operating direction. Output openings 65 of storage bin 60 deliver the ballast bed material from the bin to discharge device 66 which discharges the material at discharge point 67 behind excavating point 57 into track 49. The ballast bed material discharge arrangement is similar to that of the embodiment of FIG. 1 described hereinabove. To enable a sand protective layer to be smoothed and compacted in case installation 47 is used for the total renewal of a track bed, vertically adjustable planing device 68 is linked to machine frame 51 rearwardly of discharge point 67 in the operating direction.

Installation 47 may be operated in a manner similar to that described hereinabove in connection with installation 1, i.e. it may be used for a conventional ballast cleaning operation, with or without additional clean ballast being delivered to the rehabilitated ballast bed, or for a total renewal of the ballast bed, with or without the application of a protective sand layer over the exposed subgrade.

Figure 3:
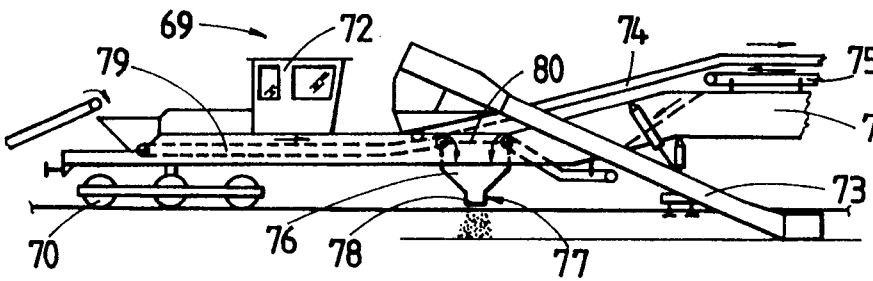
FIGS. 3 and 4 are fragmentary side elevational views showing two additional embodiments.

FIG. 3 illustrates the rear portion of still another embodiment of an installation 69 for the rehabilitation of a ballast bed. The installation comprises machine frame 71 supported on the track by undercarriages 70. Mounted on the machine frame are cab 72 and vertically adjustable excavating device 73 for continuously excavating dirty ballast which is removed by conveyor band 74 extending in the longitudinal direction (see small arrow). Conveyor device 75, which is also mounted on machine frame 71, conveys cleaned ballast in a direction opposite to the conveyance of conveyor band 74 (see small arrow) to storage bin 76 which has bottom output openings 78 constituting discharge device 77. Output openings 78 are preferably arranged at the gage and field sides of each track rail to distribute the cleaned ballast conveyed by conveyor device 75 in the track. Installation 69 furthermore also comprises transfer conveyor band 79 which can receive additional ballast bed material, such as sand or new ballast, in a manner described hereinabove in connection with FIGS. 1 and 2, and deliver the same to input opening 80 of storage bin 76. In principle, this installation can be operated in the same manner as the installations of FIGS. 1 and 2.

Figure 4:
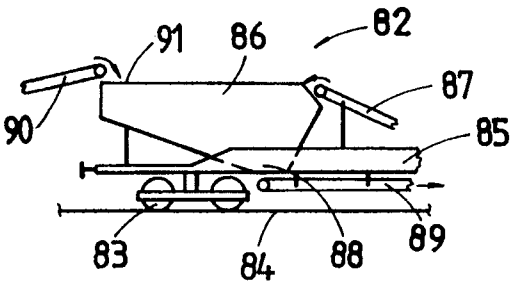

In the embodiment of FIG. 4, finally, which is similar to that of FIG. 2 and of which only the rear portion is shown, installation 82 comprises machine frame 85 supported by undercarriages 83 on track 84. Storage bin 86 having input opening 91 is mounted on the rear end of the machine frame and cleaned ballast coming from a screening device is delivered to the storage bin by conveyor device 87. Output openings 88 of the storage bin deliver the bulk material in the bin to discharge device 89. In contrast to the embodiment of FIG. 2, there is no cab mounted at the rear end of the machine frame but storage bin 76 is mounted on machine frame 85 directly at the rear end above rear undercarriage 83. This makes it possible to feed ballast bed material, such as new ballast or sand, into input opening 91 of the storage bin directly by a transfer conveyor band 90 mounted on a freight car in which the ballast bed material is stored and which is coupled to the rear end of machine frame 85.

What is claimed is:

1. An installation for the continuous rehabilitation of a ballast bed resting on a subgrade for supporting a track including two rails, which comprises an elongated machine frame means extending in a longitudinal direction and supported on the track by undercarriages for movement in an operating direction, the machine frame means comprising a machine frame having a rear end in the operating direction supported by a rear one of the undercarriages, and further comprising (a) a vertically adjustable ballast excavating device mounted on the machine frame for continuously excavating dirty ballast, the rear undercarriage trailing the ballast excavating device, (b) a screening device for cleaning the excavated dirty ballast mounted on the machine frame, (c) a storage bin for holding bulk material and arranged rearwardly of the screening device in the operating direction and close to the rear end of the machine frame, the storage bin being mounted on the machine frame ahead of the rear undercarriage and rearwardly of the ballast excavating device in the operating direction, (d) a conveyor device mounted on the machine frame for conveying the cleaned excavated ballast from the screening device to the storage bin, (1) the storage bin comprising an input opening for delivering bulk material to the bin independently of the conveyor device, and (e) a discharge device arranged to receive the bulk material from the storage bin and to discharge the received bulk material to the subgrade in front of the rear undercarriage.

2. The installation of claim 1, wherein the input opening is a funnel spaced from the storage bin in the direction of the rear end.

3. The installation of claim 1, further comprising an operator's cab mounted on the machine frame means near the rear end thereof and above the storage bin.

4. The installation of claim 1, wherein the conveyor device is a conveyor band arrangement having an input end arranged to receive the cleaned ballast from the screening device, and further comprising a conveyor band arranged to receive the dirty ballast from the ballast excavating device and to convey the dirty ballast towards the screening device, the conveyor band having a discharge end above the input end of the conveyor band arrangement.

5. The installation of claim 1, further comprising a power-driven transfer conveyor band extending in the longitudinal direction between the rear end of the machine frame and the input opening of the storage bin for delivering bulk material to the storage bin.

6. The installation of claim 1, wherein the screening device is mounted on the machine frame directly rearwardly of the ballast excavating device, the conveyor device is arranged between the screening device and the storage bin for conveying the ballast cleaned in the screening device to the storage bin, and further comprising a conveyor band arrangement mounted on the machine frame means for conveying detritus forwardly in the operating direction.

7. An installation for the continuous rehabilitation of a ballast bed resting on a subgrade for supporting a track including two rails, which comprises an elongated machine frame means extending in a longitudinal direction and supported on the track by undercarriages for movement in an operating direction, the machine frame means comprising a machine frame having a rear end in the operating direction supported by a rear one of the undercarriages, and further comprising (a) a vertically adjustable ballast excavating device mounted on the machine frame for continuously excavating dirty ballast, the rear undercarriage trailing the ballast excavating device, (b) a screening device for cleaning the excavated dirty ballast mounted on the machine frame, (c) a storage bin for holding bulk material and arranged rearwardly of the screening device in the operating direction and close to the rear end of the machine frame, the storage bin being mounted on the machine frame ahead of the rear undercarriage and rearwardly of the ballast excavating device in the operating direction, (d) a conveyor device mounted on the machine frame for conveying the cleaned excavated ballast from the screening device to the storage bin, (1) the storage bin comprising an input opening for delivering bulk material to the bin independently of the conveyor device, (e) a discharge device arranged to receive the bulk material from the storage bin and to discharge the received bulk material to the subgrade in front of the rear undercarriage, and (f) an operator's cab mounted on the machine frame near the rear end thereof and above the storage bin, (1) the operator's cab having a bottom window arranged to permit a free view of the storage bin therebelow.

8. An installation for the continuous rehabilitation of a ballast bed resting on a subgrade for supporting a track including two rails, which comprises an elongated machine frame means extending in a longitudinal direction and supported on the track by undercarriages for movement in an operating direction, the machine frame means comprising a machine frame having a rear end in the operating direction supported by a rear one of the undercarriages, and further comprising (a) a vertically adjustable ballast excavating device mounted on the machine frame for continuously excavating dirty ballast, the rear undercarriage trailing the ballast excavating device, (b) a screening device for cleaning the excavated dirty ballast mounted on the machine frame, (c) a storage bin for holding bulk material and arranged rearwardly of the screening device in the operating direction and close to the rear end of the machine frame, the storage bin being mounted on the machine frame ahead of the rear undercarriage and rearwardly of the ballast excavating device in the operating direction, (d) a conveyor device mounted on the machine frame for conveying the cleaned excavated ballast from the screening device to the storage bin, (1) the storage bin comprising an input opening for delivering bulk material to the bin independently of the conveyor device, (e) a discharge device arranged to receive the bulk material from the storage bin and to discharge the received bulk material to the subgrade in front of the rear undercarriage, (1) the discharge device being comprised of two independently power-driven discharge conveyor bands extending in the longitudinal direction, a respective one of the discharge conveyor bands extending above each one of the track rails, and (f) a respective drive for pivoting each one of the discharge conveyor bands about a vertical axis.

9. The installation of claim 8, wherein each one of the discharge conveyor bands has an input end directly below a discharge opening of the storage bin.

* * * * *